United States Patent [19]

Mason et al.

[11] 4,425,710

[45] Jan. 17, 1984

[54] ROOFING CAP CUTTER

[75] Inventors: Michael P. Mason, New Castle; Robert R. Scaran, Newark, both of Del.

[73] Assignee: Cap Cutters, Inc., Newark, Del.

[21] Appl. No.: 337,950

[22] Filed: Jan. 7, 1982

[51] Int. Cl.[3] ..... B26B 13/04; B26B 13/06

[52] U.S. Cl. ..... 30/229; 30/132

[58] Field of Search ..... 83/920, 693; 30/124, 30/178, 229, 230, 132; 144/217; 52/748

[56] References Cited

U.S. PATENT DOCUMENTS

| | | | |
|---|---|---|---|
| 922,058 | 5/1909 | Squair | 30/355 X |
| 3,279,295 | 10/1966 | Teplitz | 30/229 UX |
| 4,102,045 | 7/1978 | Bergh | 30/178 X |

*Primary Examiner*—E. R. Kazenske
*Assistant Examiner*—Douglas D. Watts
*Attorney, Agent, or Firm*—Mortenson & Uebler

[57] ABSTRACT

A device is provided for cutting roofing caps efficiently and easily from standard asphalt or fiberglass roofing shingles. The device comprises a support base to hold a shingle, the support base being hinged to a top plate having cutting blades affixed thereto. The support base has cut-outs corresponding with and acting cooperatively with the configuration of the cutting blades. Standard shingles can be cut to desired patterns. Preferably two interior, wedge-shaped cut-outs and two exterior, beveled cut-outs are employed in the support plate, and cutting blades are arranged in the top plate so as to penetrate the shingle along the bevels and the sides of the wedges and thereby cut the shingle in the desired pattern and permit unwanted shingle material to fall away and be discarded, producing three precision-cut roofing caps from each shingle.

6 Claims, 12 Drawing Figures

ROOFING CAP CUTTER

BACKGROUND OF THE INVENTION

This invention relates to sheet-cutting machines, and more particularly to an improved device for cutting roofing caps for installation along the ridge of a roof from conventional, two or three-panel asphalt or fiberglass roofing shingles.

Many devices exist in the prior art used to cut roofing materials into shingles and the like. U.S. Pat. No. 1,831,374 discloses one such device. Therein, composition roofing material supplied in long sheets or rolls is cut into small, individual roofing units such as slates, tiles or shingles to produce a more pleasing aesthetic effect than full width sheets.

Other devices are known for cutting shingles and the like. Exemplary are those disclosed in the following U.S. Pat. Nos. 131,024; 1,273,623; 1,302,414; 1,473;377; 1,475,551; 1,548,107; 1,583,977; 1,601,128; 1,762,405; 1,840,997; 1,956,285; 2,088,686; and 3,134,285.

Standard asphalt or fiberglass roofing shingle material is presently available in generally rectangular sheet form. Each sheet contains one or two slots cut partially through the sheet separating each such sheet into one or two tabs or panels, respectively.

The present method for cutting caps to place along the ridge line of roofs for houses and the like is simply to take a roofers knife and cut standard shingles by hand to the desired shape. This method is time-consuming and therefore expensive, dangerous and, most importantly, imprecise.

This invention obviates the difficulties of present methods for cutting roof caps and provides a machine for cutting such caps quickly, safely, economically and precisely.

SUMMARY OF THE INVENTION

A device for cutting roofing caps is provided comprising a supporting base large enough to hold thereon a standard, three-tab roofing shingle, transverse hinge means extending along one edge of the supporting base and being affixed thereto, a top plate for supporting cutting blades in a desired configuration, the top plate being hinged to the supporting base by the hinge means along the one edge thereof, the top plate having handle means for raising the top plate in order to place a standard three-tab roofing shingle on the supporting base and for lowering the top plate to cut the roofing shingle as desired, there being cut-outs in the supporting base in the desired pattern whereby the blades and the cut-outs act cooperatively to cut the shingle in the pattern desired and permit unwanted shingle material to fall away and be discarded, whereby three precision-cut roofing caps are produced from each shingle.

The supporting base is generally rectangular and substantially the size of a standard three-panel roofing shingle. The cut-outs in the supporting base are as follows:

(a) two interior wedge-shaped cut-outs having apexes substantially at the locations of the interior ends of the two dividing slots in the standard roofing shingle where the shingle is placed upon the supporting base, (b) two exterior beveled cut-outs each extending from one exterior end of the base at a point on a horizontal line extending through the apex of both interior wedges, inwardly, parallel to one side of the wedges.

The cutting blades in the top plate extend perpendicularly therefrom and are affixed so as to cooperate with the cut-outs to cut two interior wedges and two exterior bevels from the shingle, thereby producing precision-cut roofing caps.

The included angle formed by the sides of the wedges and their respective cooperating blades is approximately 32° and the angle formed by the side of each exterior bevel and their respective blades and the side of the supporting base is approximately 16°.

DETAILED DESCRIPTION OF THE INVENTION AND PREFERRED EMBODIMENTS WITH REFERENCE TO THE DRAWINGS

A device is provided for cutting roofing caps efficiently and easily from standard asphalt or fiberglass roofing shingles. The device comprises a support base to hold a shingle, the support base being hinged to a top plate having cutting blades affixed thereto. The support base has cut-outs corresponding with and acting cooperatively with the configuration of the cutting blades. Standard shingles can be cut to desired patterns. Preferably two interior, wedge-shaped cut-outs and two exterior, beveled cut-outs are employed in the support plate, and cutting blades are arranged in the top plate so as to penetrate the shingle along the bevels and the sides of the wedges and thereby cut the shingle in the desired pattern and permit unwanted shingle material to fall away and be discarded, producing three precision-cut roofing caps from each shingle.

The details of this invention can best be described by reference to the accompanying drawings. Dimensions can be either English or metric, as desired.

Figure 8:
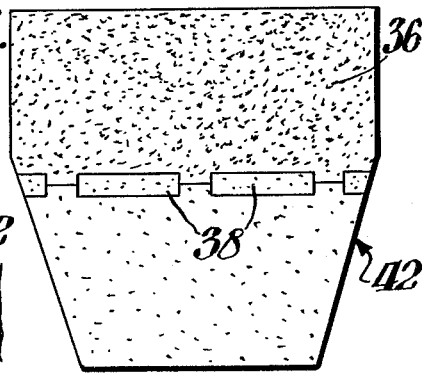
FIG. 8 shows a roofing cap cut according to the principles of this invention.
Figure 10:
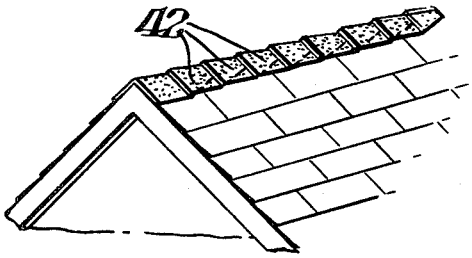
FIG. 10 shows a number of the roofing caps cut according to the principles of this invention installed on the ridge of a roof.

The device cuts standard roofing shingles to produce roof caps such as that shown in FIG. 8 to place along the ridge of a roof line as shown in FIG. 10. Standard asphalt or fiberglass shingle material is commercially available in rectangular slotted sheets, each sheet having three panels or tabs, each tab separated by a slot extending approximately halfway across the shingle. When one such shingle is properly placed in the device of this invention and cut, all waste material falls away clear of the device and three roof caps are produced efficiently and economically with each cut.

Figure 1:
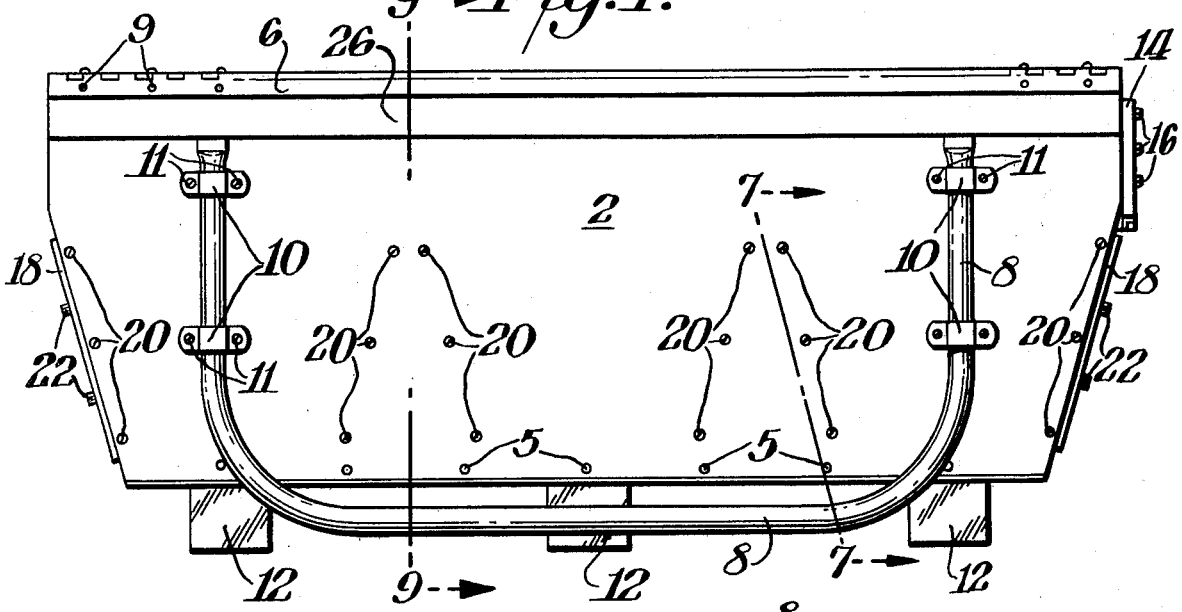
FIG. 1 is a top plan view of the roofing cap cutter of this invention.

FIG. 1 shows the device of this invention in a top plan view. Materials of construction are preferably aluminum for structural elements and steel for the cutting blades, although one skilled in the art could use other suitable materials without deviating from the scope of the invention. Top plate 2 is shown hinged along one edge thereof to the bottom support base by hinge means 6 affixed to the top plate 2 and support base by hinge bolts 9, extending through top plate support bar 26.

Handle 8 is shown in FIG. 1 affixed to top plate 2 by means of handle clamps 10 and bolts 11. This handle serves a dual purpose. First, it is used to raise and lower top plate 2 in order to insert a shingle in the device and then to cut the shingle into roof caps. Second, when not in use, the handle means 8 is used to conveniently transport the device from one location to another.

Extending outwardly from underneath the device are extended base supports 12. The handle 8 preferably extends over these supports 12 as shown for additional leverage and stability. The supports 12 are described in more detail hereinbelow.

Shingle guide 14 is shown affixed to the device in FIG. 1 by means of bolts 16. This guide serves to quickly and easily position a shingle properly prior to cutting it into roof caps.

Outer cutting blades 18 are shown affixed to the top plate 2 in FIG. 1 by means of blade supports 32 (not shown) and bolts 22. These blade assemblies are affixed to the top plate by bolts 20 extending through the top plate and into the blade supports 32, which will be described more fully hereinafter.

Figure 2:
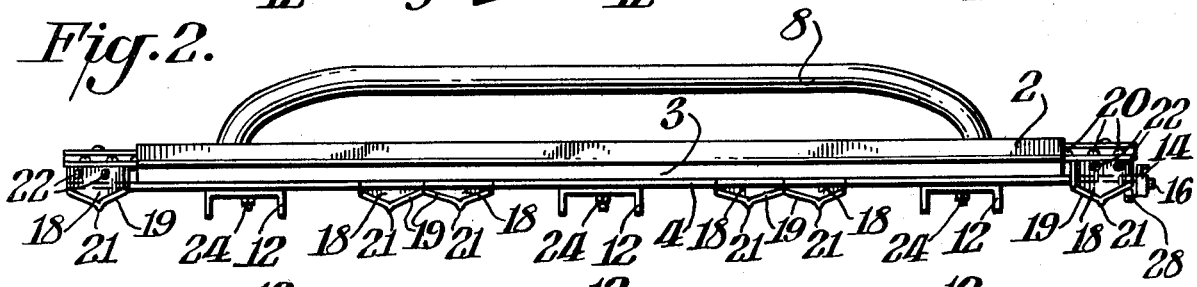
FIG. 2 is a front elevational view thereof.

FIG. 2 shows a front elevational view of the device of this invention in the closed position. Cutting blades 18 are shown affixed to top plate 2 by means of bolts 22, the blades extending downwardly through supporting base plate 4. Handle 8 for raising and lowering the top plate 2 is shown affixed to the top plate. Extended base supports 12 are shown bolted to support base 4 by bolts 24. At the extreme right end of FIG. 2 is shown the shingle guide 14 and bolts 16 for attaching the shingle guide to the support base. Cutting blades 18 are shown to be tapered generally toward the center, to a cutting point, the taper being designated as 19 and the cutting point as 21, respectively. This configuration will be described more fully hereinbelow. Such configuration greatly facilitates the cutting of the shingle material according to this invention.

Figure 3:
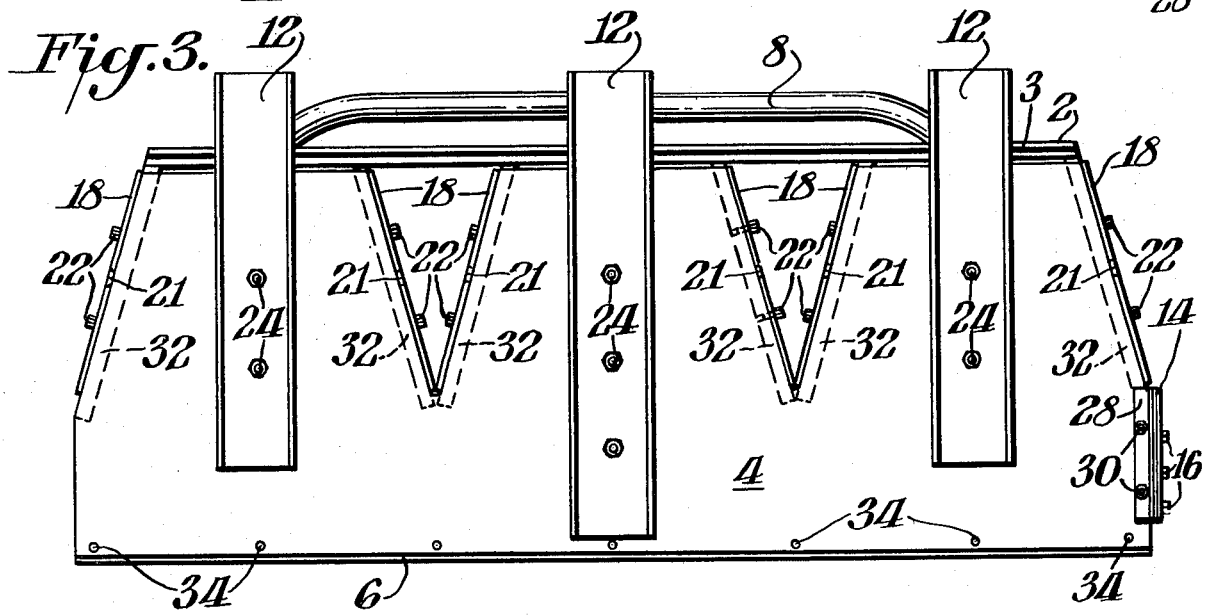
FIG. 3 is a bottom plan view of this device showing the cut-out areas in the support base and the cooperating blades in relation thereto.

FIG. 3 shows, in bottom plan view, the device of this invention. Extended, stabilizing base supports 12 are shown bolted to support base 4 by bolts 24, extending outwardly from the support base as shown. Handle 8 can be seen extending over the extended supports 12. The support base 4 has exterior, beveled cut-outs at each end thereof and two interior, wedge-shaped cut-outs as shown. Blades 18 affixed to blade supports 32 by bolts 22 are shown extending into the wedge-shaped cut-outs and exterior, beveled cut-outs. Hinge means 6, bolts 34 for the support base, shingle guide 14 having bolts 16, and shingle guide support 28 having bolts 30 are shown for completeness. Top plate 2 and support bar 3 can be seen extending slightly over support base 4.

Figure 4:
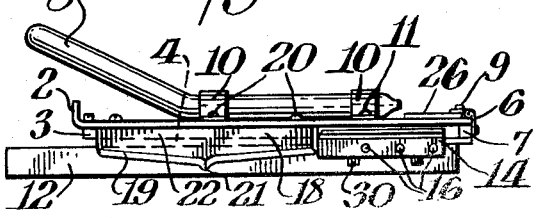
FIG. 4 is a side elevational view of the device of this invention.

FIG. 4 shows the support base 4 mounted upon the extended supports 12, with upper plate 2 and support bar 3 mounted on top thereof. Handle 8 is affixed to top plate 2 by handle clamps 10 and bolts 11. Hinge 6 and hinge support 7 are shown in the closed position, affixed to top plate 2 by top plate support 26 and bolts 9. Shingle guide 14, bolts 16 and 30 and tapered cutting blades 18 having tapers 19 and points 21 can be seen in side elevation.

Figure 5:
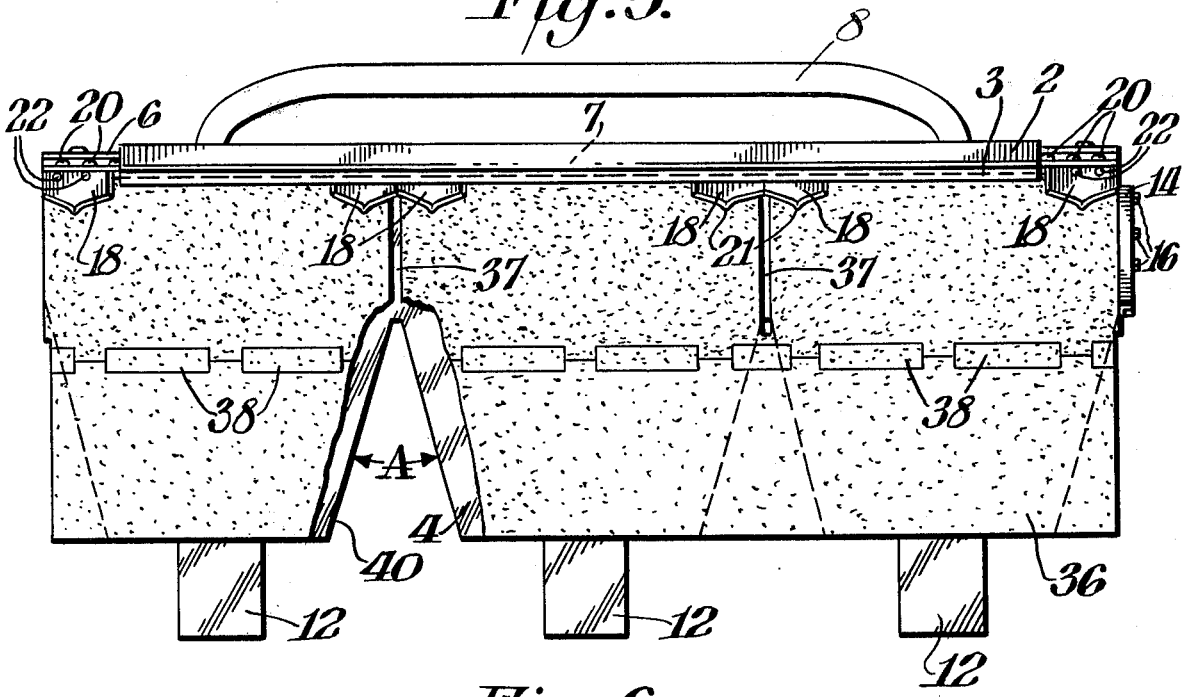
FIG. 5 is a top plan view thereof with the device in the open position showing a shingle placed on the support base about to be cut, in part broken away.

FIG. 5 shows the device of this invention in the open position in a top plan view. Therein a standard roofing shingle 36 partially broken away is shown placed upon support base 4 and aligned using shingle guide 14. In the cutaway, the wedge-shaped interior cut-out in support base 4 is shown having included angle "A". Angle A is preferably approximately 32°. Slots 37 and seal tabs 38 are shown such that, as a shingle is cut, the apex of the wedge-shaped cut-outs 40 extends to the slots 37, and the wedges cut from the shingle and the beveled ends cut from the shingle shown in phantom fall away upon cutting and can be discarded. The relative positioning of hinge 6, hinge support 7, handle 8, top plate 2 and support bar 3, cutting blades 18 having cutting points 21, bolts 16, 20, 22 and extended base supports 12 are shown for clarity of presentation.

Figure 6:
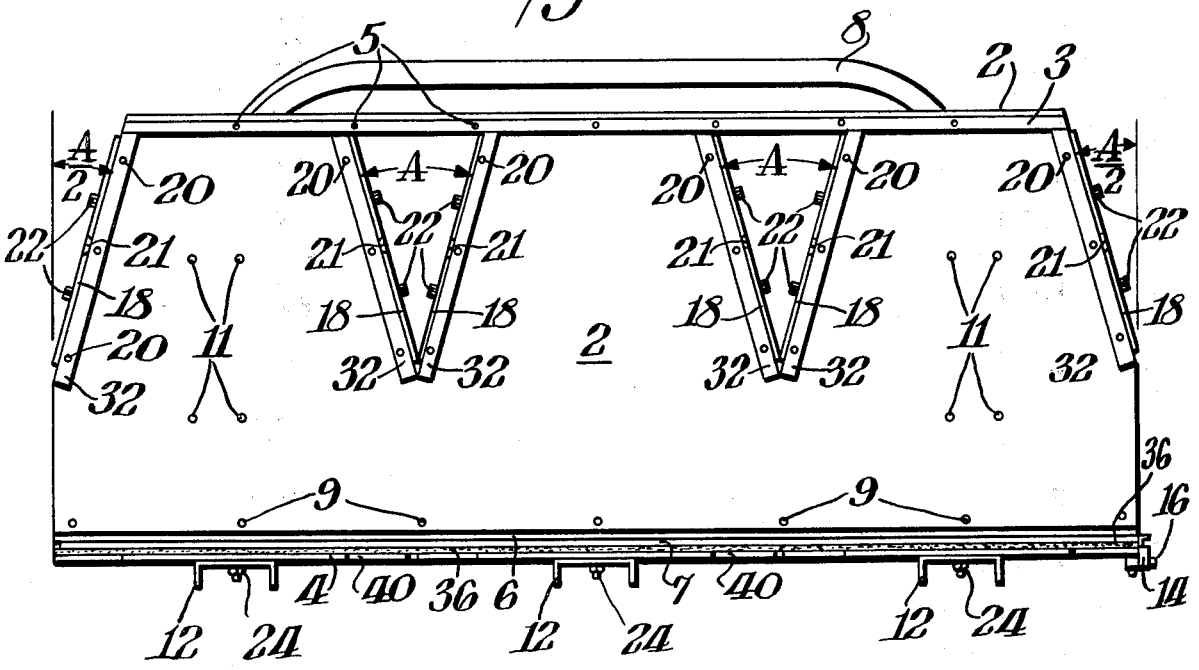
FIG. 6 is a front elevation with the device in the open position as in FIG. 5.

FIG. 6 shows the device of this invention in the open position in front elevation, ready to cut shingle 36. The exterior cutting blades 18 mounted on the ends of top plate 2 are angled to the vertical at an angle of A/2 preferably. This angle is preferably approximately 16°. The interior cutting blades 18 are mounted as shown to act cooperatively with the wedge-shaped cut-outs 40 in the support base to cut a shingle. Blades 18 are secured to blade supports 32 by bolts 22. The blade supports are bolted to the top plate 2 by means of bolts 20. The hinge means, hinge support, extended base supports 12, shingle guide 14, handle 8 and various bolts are included for clarity.

Figure 7:
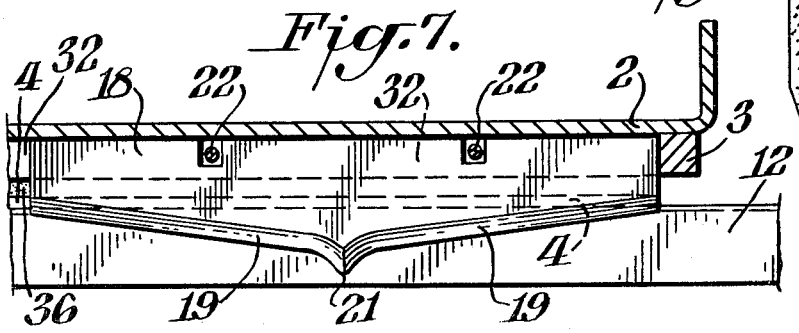
FIG. 7 is a cross-sectional view in elevation taken along line 7—7 of FIG. 1 showing details of the cutting blade assembly.

FIG. 7 shows a cutting blade 18 having penetrated a shingle sheet 36. Blade 18 attached to blade support 32 by bolts 22 extends downwardly past support base 4 and through shingle 36. The cutting blades are preferably tapered at 19 and come to a point 21 interior to their ends. In this way, the point 21 pierces the shingle initially and cutting proceeds outwardly therefrom. It may be advantageous that the point 21 be offset somewhat from blade to blade. In this way, as a shingle is cut, each of the six separate blades will initially penetrate the shingle at a different instant in time and the instantaneous force required to effect penetration is lessened.

FIG. 8 shows a roof cap product cut using the device of this invention. Cap 42 has the desired, approximately 16° beveled edge, cut from shingle material 36.

Figure 9:
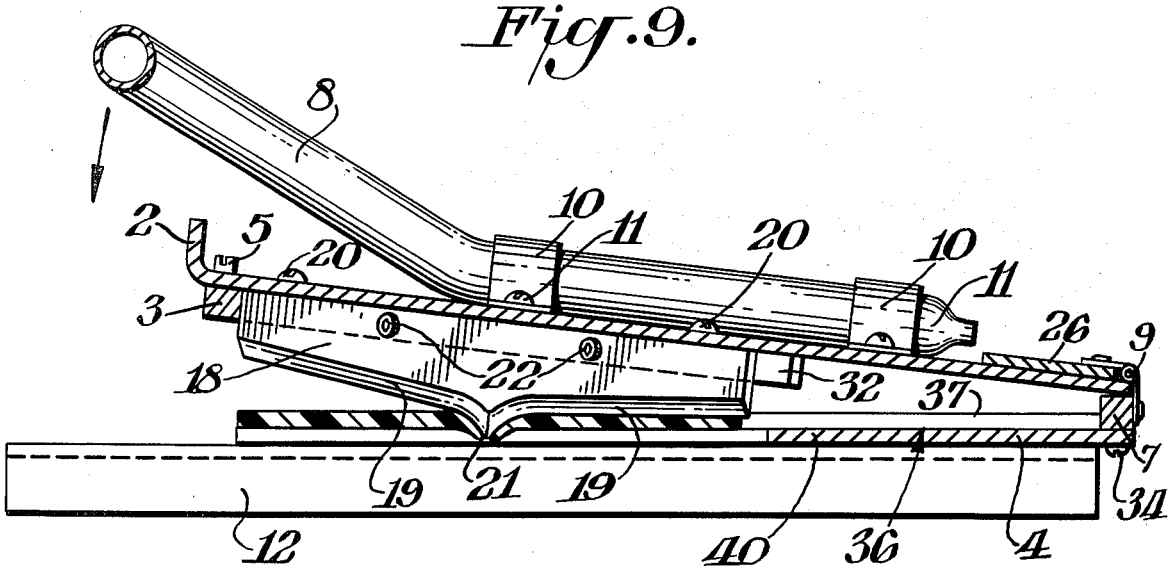
FIG. 9 is a cross-sectional view of this invention taken along line 9—9 of FIG. 1 showing one cutting blade as it begins to cut a roofing shingle.

FIG. 9 is an enlarged side elevational view showing a cutting knife 18 as it initially penetrates shingle material 36 and begins cutting therethrough. FIG. 9 is taken along line 9—9 of FIG. 1. As handle 8 is depressed as shown by the arrow, the cutting blade 18 in cooperation with wedge-shaped cut-out 40 cuts the shingle material 36 wherein point 21 pierces the shingle and the tapered blades then slice the desired cut-outs. The hinges, supports and bolts are included in FIG. 9 for completeness.

FIG. 10 shows a number of roof caps 42 cut according to the principles of this invention installed along the ridge of a roof.

Figure 11:
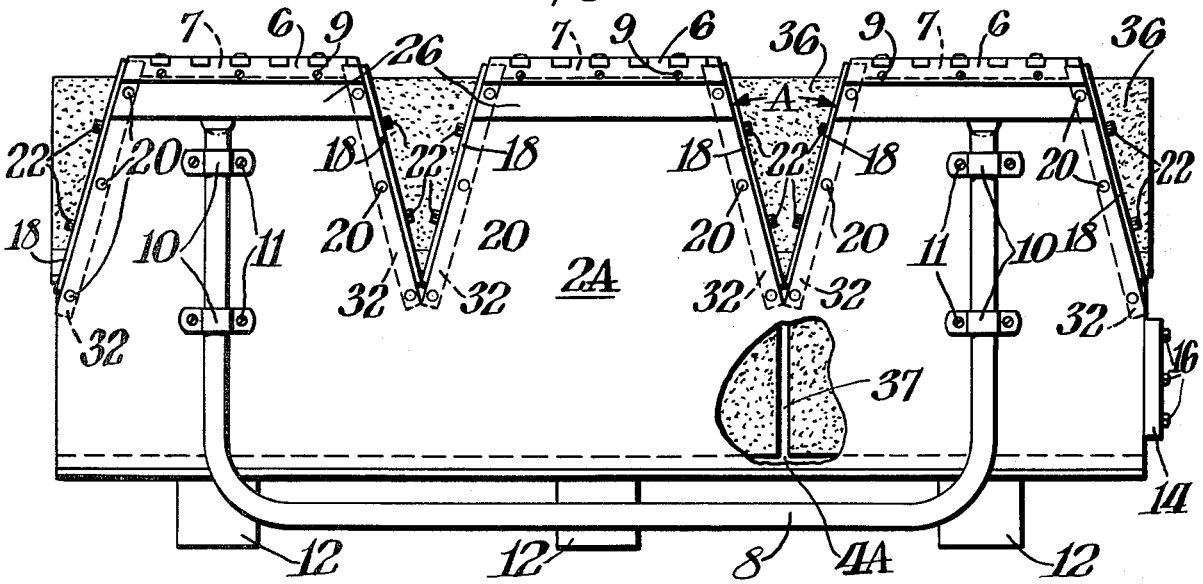
FIG. 11 shows a top plan view of an alternative embodiment of this invention wherein the hinge means is located along the same side of the device having the wedge-shaped cut-outs in the support base, in part broken away to show the orientation of the shingle and slots.

FIG. 11 shows an alternate embodiment of the device of this invention wherein the hinges which hinge the support base 4A to the top plate 2A are located on the opposite side of the device from that shown in FIG. 1. An advantage in this embodiment is that the cutting blades 18 are located as far away as possible from the hands of the operator. In this embodiment, the shingle 36 is reversed as shown in the cut-away, thereby placing the slots 37 such that the apex of the wedge-shaped cut-outs is adjacent the innermost portion of slot 37. Top plate 2A is shown having cut-outs and blades 18 attached to blade supports 32 shown in phantom. It is clear that top plate 2A need not be cut-out as shown but may be a continuous plate as is plate 2 in FIG. 1. This is a matter of convenience and ease of manufacture.

Figure 12:
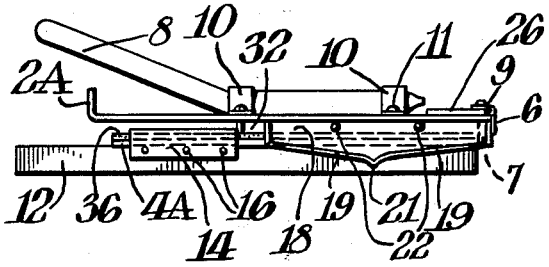
FIG. 12 is a side elevational view of an alternative embodiment of the device of this invention depicted in FIG. 11.

FIG. 12 shows the alternate embodiment of the invention depicted in FIG. 11 in side elevation. With the exception of locating the cut-outs and blades 18 of the device adjacent the hinged edge of the device, and reversing the position of the shingle to be cut therein, the operation of this alternate device in all essential respects is as described hereinabove in connection with the embodiment depicted in FIGS. 1–9.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow. In particular, a small unit being essentially one-third of the device shown in the drawings, is contemplated for certain applications.

We claim:

1. A device for cutting roofing caps comprising:

a supporting base large enough to hold thereon a standard, three-tab roofing shingle, transverse hinge means extending along one edge of said supporting base and being affixed thereto, a top plate for supporting cutting blades in a desired configuration, the top plate beng hinged to said supporting base by said hinge means along the one edge thereof, the top plate having handle means for raising the top plate in order to place a standard three-tab roofing shingle on said supporting base and for lowering the top plate to cut said roofing shingle as desired, cutting blades supported in the desired configuration by said top plate, there being cut-outs in said supporting base in the desired pattern whereby said blades and said cut-outs act cooperatively to cut said shingle in the pattern desired and permit unwanted shingle material to fall away and be discarded, said cut-outs being as follows:

(a) two interior wedge-shaped cut-outs having apexes substantially at the location of the interior ends of the two dividing slots in said standard roofing shingle when said shingle is placed upon said supporting base, (b) two exterior beveled cut-outs each extending from one exterior end of said base at a point on a horizontal line extending through the apex of both interior wedge-shaped cut-outs inwardly parallel to one side of said wedge-shaped cut-outs, the cutting blades in said top plate extending perpendicularly therefrom and being affixed so as to cooperate with said cut-outs to cut two interior wedges and two exterior bevels from said shingle, thereby producing three of said precision-cut roofing caps in one operation, whereby precision-cut roofing caps are produced from each said shingle.

2. The device of claim 1 wherein the included angle formed by the sides of said wedge-shaped cut-outs and their respective cooperating blades is approximately 32° and the angle formed by the side of each exterior beveled cut-outs and their respective blades and the side of said supporting base is approximately 16°.

3. The device of claim 1 having a guide bar attached to one side of said supporting base to enable easy and rapid replacement of said shingle thereon.

4. The device of claim 1 wherein the cutting edges of said blades are tapered from each end thereof and form a point substantially at the center between said ends.

5. The device of claim 1 wherein the cutting edges of said blades are tapered from each end thereof and form a point at a location offset from the center between said ends.

6. The device of claim 1 wherein the cutting edges of said blades are tapered from each end thereof and form a point, each point of each blade being offset from each point of each other blade.

* * * * *